US008567878B2

(12) United States Patent
Wylie et al.

(10) Patent No.: US 8,567,878 B2
(45) Date of Patent: Oct. 29, 2013

(54) TOILET USERS ROLLABLE DESK

(76) Inventors: Brian Wylie, Ft Lauderdale, FL (US); Cameron Wylie, New Orleans, LA (US)

( * ) Notice: Subject to any disclaimer, the term of this patent is extended or adjusted under 35 U.S.C. 154(b) by 0 days.

(21) Appl. No.: 13/041,190

(22) Filed: Mar. 4, 2011

(65) Prior Publication Data

US 2012/0223627 A1 Sep. 6, 2012

(51) Int. Cl.
*B65H 19/00* (2006.01)

(52) U.S. Cl.
USPC ..... 312/34.1; 312/233

(58) Field of Classification Search
USPC ..... 312/249.8, 249.13, 231, 233, 287, 34.1, 312/34.22, 223.3; 108/6, 9, 29, 32, 93, 101, 108/50.02; 4/661, 551, 573.1, 578.1, 667, 4/604, 480
See application file for complete search history.

(56) References Cited

U.S. PATENT DOCUMENTS 1,272,645 A * 7/1918 Fanning ..... 312/279
1,997,585 A * 4/1935 Hunter ..... 312/204
2,184,822 A * 12/1939 Unger ..... 312/233
4,913,502 A * 4/1990 Russell ..... 312/233
5,560,051 A * 10/1996 Butts ..... 4/479
5,806,943 A * 9/1998 Dell et al. ..... 312/223.3
6,024,427 A * 2/2000 Underwood et al. .... 312/249.12
6,145,800 A * 11/2000 Watkins ..... 248/461
6,435,109 B1 * 8/2002 Dell et al. ..... 108/144.11
6,443,543 B1 * 9/2002 Chiang ..... 312/223.3
6,460,950 B2 * 10/2002 Spitzer et al. ..... 312/249.8
6,530,631 B2 * 3/2003 Brown ..... 312/280
7,612,999 B2 * 11/2009 Clark et al. ..... 361/679.4
7,677,678 B2 * 3/2010 Mosel et al. ..... 312/231
7,908,978 B1 * 3/2011 Pelton, Jr. ..... 108/50.02
2002/0113531 A1 * 8/2002 Ma ..... 312/223.3
2003/0080655 A1 * 5/2003 Goldberg ..... 312/290
2006/0273703 A1 * 12/2006 Hardt, II ..... 312/249.13
2010/0213801 A1 * 8/2010 Ceballos-Godefroy ... 312/249.8

* cited by examiner

*Primary Examiner* — Darnell Jayne
*Assistant Examiner* — Hiwot Tefera

(57) ABSTRACT

A toilet users rollable desk for a compact personal office desk for the commode user. A toilet users rollable desk generally includes a desk that provides the toilet user with a space between the knees and legs to read, write, use the computer and store personal items as well as a shelf to place coffee or nourishment. A toilet users rollable desk is also able to store toilet tissue, hold reading material and be conveniently moved in front of the commode user for all processes to be best utilized in the large, average or small toilet commode area.

1 Claim, 8 Drawing Sheets

TOILET USERS ROLLABLE DESK

CUSTOMER #90603 FRONT VIEW

TOILET USERS ROLLABLE DESK

TOILET USERS ROLLABLE DESK

CUSTOMER #90603 OPEN VIEW

TOILET USERS ROLLABLE DESK

CUSTOMER #90603

OPEN FUNCTION

TOILET USERS ROLLABLE DESK

CUSTOMER #90603 INSIDE DESK

TOILET USERS ROLLABLE DESK

CUSTOMER #90603 FEATURES

TOILET USERS ROLLAPLE DESK

CUSTOMER #90603 USER ANGLES

TOILET USERS ROLLABLE DESK

CUSTOMER #90603 USER

TOILET USER (with) ROLLABLE DESK

TOILET USERS ROLLABLE DESK

BACKGROUND OF THE INVENTION

The present invention relates generally to furniture for the bathrooms and more specifically it relates to a toilet users rollable desk as A compact personal office desk for the commode user.

The search for prior art on the internet included, but not limited to words and phrases in each and every combination thereof: organizational, bathroom, restroom, commode, toilet, furniture, desk, compact, magazine, rack, toilet tissue, holder, rolling, roll-able and caddy.

The same words and phrases were used to search for prior art in USPTO CCLs:

a) 4/253, 254, 300, 307, 378, 418, 420, 422, 424, 438, 441, 457, 476, 479, 480, 483, 484, 485.
b) 221/33, 47, 48, 63, 115, 194, 196, 251, 255, 263.
c) D23/270, 286, 303, 308; 220/477.
d) 312/45, 72, 206, 207, 228, 237.
e) 630, 531, 638, 643, 661.
f) D6/397, 432, 445, 509.
e) 242/560.3.

Bathrooms are typically small, cramped rooms without space for furniture of intellectual use. Because many persons use the bathroom solely as "required" the unrealized consensus is the room needn't have the capability of other wise utility as the rest of the home.

Many people live harried modern lifestyles that demand efficient productivity to compete in today's economy. This demand urges utilization of the bathroom as a place to accomplish daily requirements such as checking email, reading, writing, nourishment and taking advantage of the personal time already spent in the bathroom in addition to its original purpose.

Therefore, the modern multitasker tends to surround themselves with a myriad of disorganized items in the oft fruitless effort to facilitate productive activities while sitting on the commode.

Items such as small tables for reading, miss-fitting magazine racks, toilet tissue stacked on toilet tanks or window sills render both in-accessible. Poorly balanced coffee cups on bathtub ledges make the early morning effort difficult or worse, dangerous with hot liquid spills.

As prior art will attest, this issue has attempted to be addressed in an ineffective manner. U.S. Pat. No. 4,008,933 Wanek* attempts to reduce the need for item storage with a "utilitarian and decorative piece of bathroom furniture that holds the commode plunger, toilet rolls, bath powder and supplies." Patent US2006/0284526 A1 Pathmanathan* et al is a patent for a multipurpose "bathroom vanity that provides storage space for a bathroom scale and makes efficient use of the volume occupied in the bathroom by the vanity." U.S. Pat. D507,333 S Beltran* is a purely ornamental vanity design for bathroom furniture to hold a sink and U.S. Pat. No. 7,178,691 B1 Rux* is a toilet tissue dispenser. U.S. Pat. No. 5,974,598 Granda-Cabrera*, U.S. Pat. No. 4,368,551 Cummings*, U.S. Pat. No. 4,366,584 Mchuma* all attempt to modernize utility space by providing housings, covers for—and even folding commodes that move into the wall to allow more space but all miss the mark of providing true ergonomic and easily movable utilitarian equipment for the modern intellectual bathroom user while actually sitting on the commode.

Many home living rooms have computer and laptop desks or stands of many different types which aren't designed or meant to fit comfortably in front of a person while sitting on the commode.

A multitude of space saving and organizational bathroom vanities and cabinets for the sink and above the commode are for sale in home stores. Wooden or metal poles attached to decorative bases that hold toilet tissue is common art. Magazine racks are numerous, some combined with the toilet tissue holder.

Small ornamental metal stands that hold a cup of coffee are wobbly and not efficient at preventing spills and those that are stable may only prove to be safe because they require inconvenient installation and the search of prior art for a specifically designed 'bathroom (or commode) desk' located zero matches regardless and in short:

The many attempts in prior art to organize and provide intellectual function in the bathroom while attending to life's basic personal needs and bodily requirements has never been properly addressed until now.

Simply stated, the best method to combine service for the body and mind in the bathroom is the most minimalistic and straight forward one; to utilize A compact rollable desk that moves easily between the knees and legs of the user while sitting on the commode.

BRIEF SUMMARY OF THE INVENTION

The invention generally relates to a furniture for the bathroom which is A desk that provides the toilet user with space to store personal items, read, write, use the computer and with toilet tissue holders, magazine racks and a shelf to place one's coffee or drink.

There has thus been outlined, rather broadly, some of the features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways.

Also, it is to be understood that the phraseology and terminology employed herein are for the purpose of the description and should not be regarded as limiting.

An object is to provide A toilet users rollable desk that conveniently maneuvers in front of the person while sitting on the commode.

Another object is to provide A toilet users rollable desk for A compact furniture to hold, store and allow personal and office use of items for the person sitting on the commode.

Another object is to provide A toilet users rollable desk that provides a location to read, write and use the computer for a person sitting on the commode.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
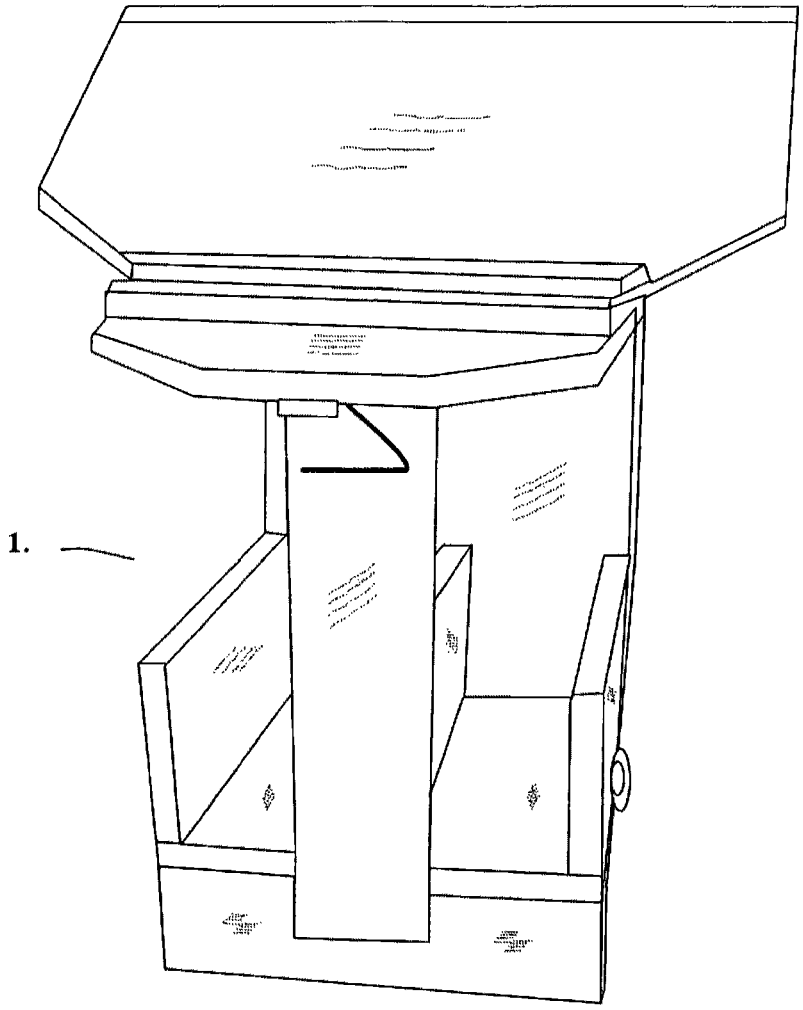
FIG. 1 is a front view of the present invention. Front view of the desk.

Turning now descriptively to the drawings, in which similar reference characters denote similar elements throughout the several views, the figures illustrate A desk that provides the toilet user with space to store personal items, read, write, use a computer as well as areas to store toilet tissue, reading materials and a shelf to place coffee or drinks.

B. Lower Base

FIG. 1 Ref 1

A base narrow and low enough to fit comfortably between the knees and legs of the toilet user sitting on the commode.

Figure 2:
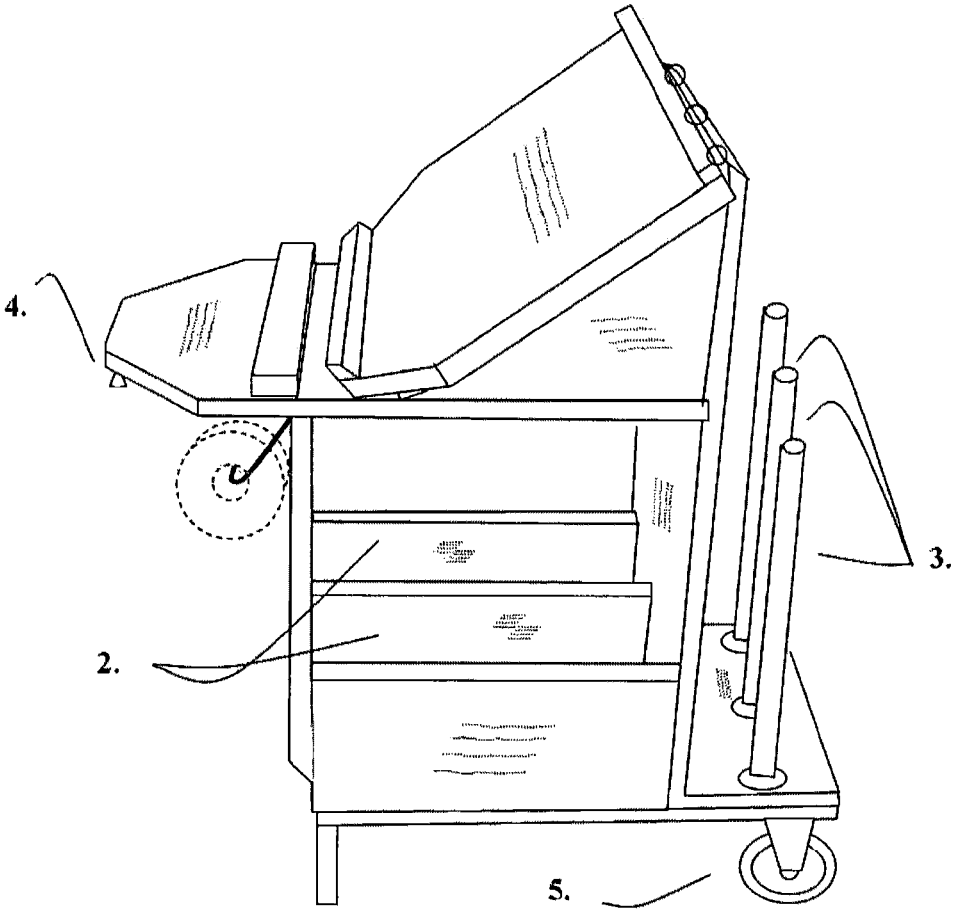
FIG. 2 is a side view of the present invention. Side view of the desk.

The base provides storage for magazines (FIG. 2 ref 2) and multiple rolls of toilet tissue (FIG. 2 ref 3) while homogeneously supporting the desk.

The base provides a handle (FIG. 2 ref 4) and swivel wheels (FIG. 2 ref 5) in which to use "caddy-style" to maneuver the toilet users rollable desk toward or away from the toilet user while sitting on the commode. It also provides the base for the desktop structure, the magazine rack and toilet tissue storage.

C. Desktop

FIG. 3

A raise-able desktop panel (ref 6) that is supported by the base to provide useful surface area (ref 7) in which to read, write and use a laptop computer as well as provide a personal mirror. (ref 8)

The desktop is a flat, shoulder-width desk surface (FIG. 3 ref 7) that hinges upward to stop at one of several positions (FIG. 4) to acquire the specific angle needed for glare-free reading of glossy printed material as well as accommodate the specific angle needed for use of a laptop or netbook computer as well as other user-preferred angles.

The desktop position adjusts up and over about 180 degrees to accommodate reading of large broad-page newspaper, blueprints and other large-sized reading material.

The desktop provides upper and lower stops (FIG. 4 ref 9) to prevent items, computers and other materials from sliding off the desk as adjusted to user preferred angles.

D. Upper Base

Figure 5:
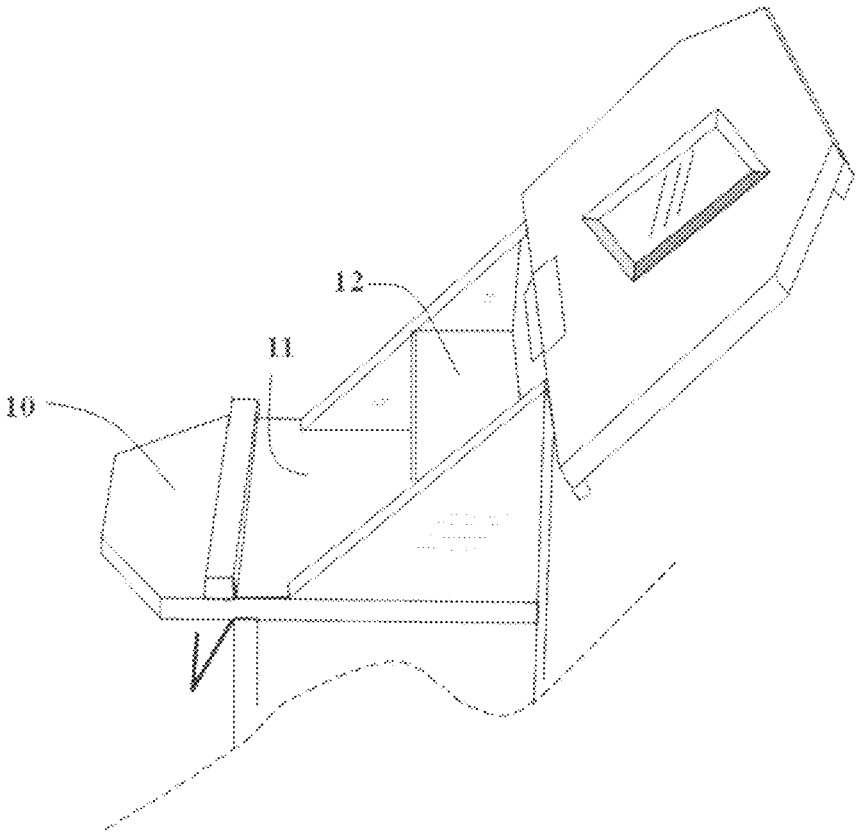
FIG. 5 is an upper perspective view of the present invention. Inside the desk.

A location in front of the desktop that provides space for coffee or drinks (FIG. 5 ref 10) a storage area under the desktop for small netbooks and office materials (ref 11) that also includes a separate shelf for storage of personal items. (ref 12)

E. Magazine Rack

Figure 6:
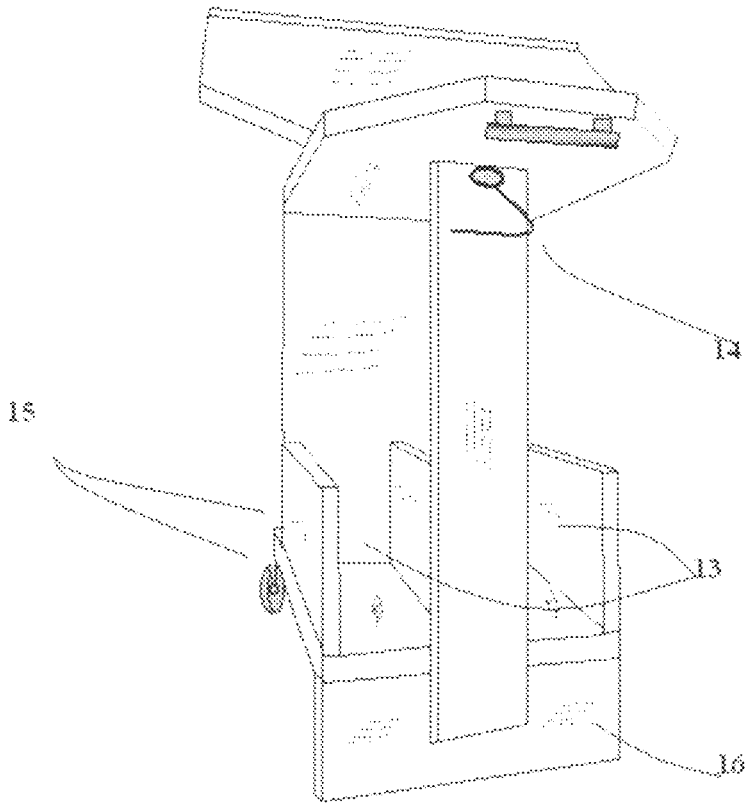
FIG. 6 is a front view of the present invention. Features of the desk.

Magazine racks (FIG. 2 ref 2) configured as part of the lower base that hold a large amount of reading material for ease of use. (FIG. 6 ref 13)

The fact that the magazine racks are partitioned and open ended allows for separation of different types of reading materials and the open ending allows for ease of reading material retrieval to the commode user as well as access to clean out the bottom.

F. Toilet Tissue Holders

Multiple toilet tissue poles (FIG. 2 ref 3) and a single toilet roll dispenser (FIG. 6 ref 14) are part of the base which hold many rolls of toilet tissue for storage and one roll for immediate and convenient use to the toilet user while sitting on the commode.

G. Wheels and Caddy Front of Base

Two swivel wheels (FIG. 6 ref 15) and a caddy style support that are naturally part of the base allows the toilet users rollable desk to be maneuvered easily in front of, used in a stable non-slip manner and then easily rolled away from the user finished on the toilet.

The wide non-roll-able kick-plate (FIG. 6 ref 16) at the bottom front of the toilet users rollable desk allows for the desk to sit firmly in place while in use without the need for locking wheels, modification, installation or other means of support to provide stability.

H. Connections of Main Elements and Sub-Elements of Invention

The toilet users rollable desk is a single unit supported by a base and has storage inside and out (FIG. 5) for all items to be used while sitting on the commode.

I. Alternative Embodiments of Invention

The toilet users rollable desk is free standing, complete in itself and not dependent upon the bathroom, toilet facilities or fixtures and does not require installation, attachment or modifications of any kind to itself or physical structures of the toilet area in order to be fully useful in its designed function. It could be used anywhere in the home as a maneuverable desk fixture.

J. Operation of Preferred Embodiment

Figure 8:
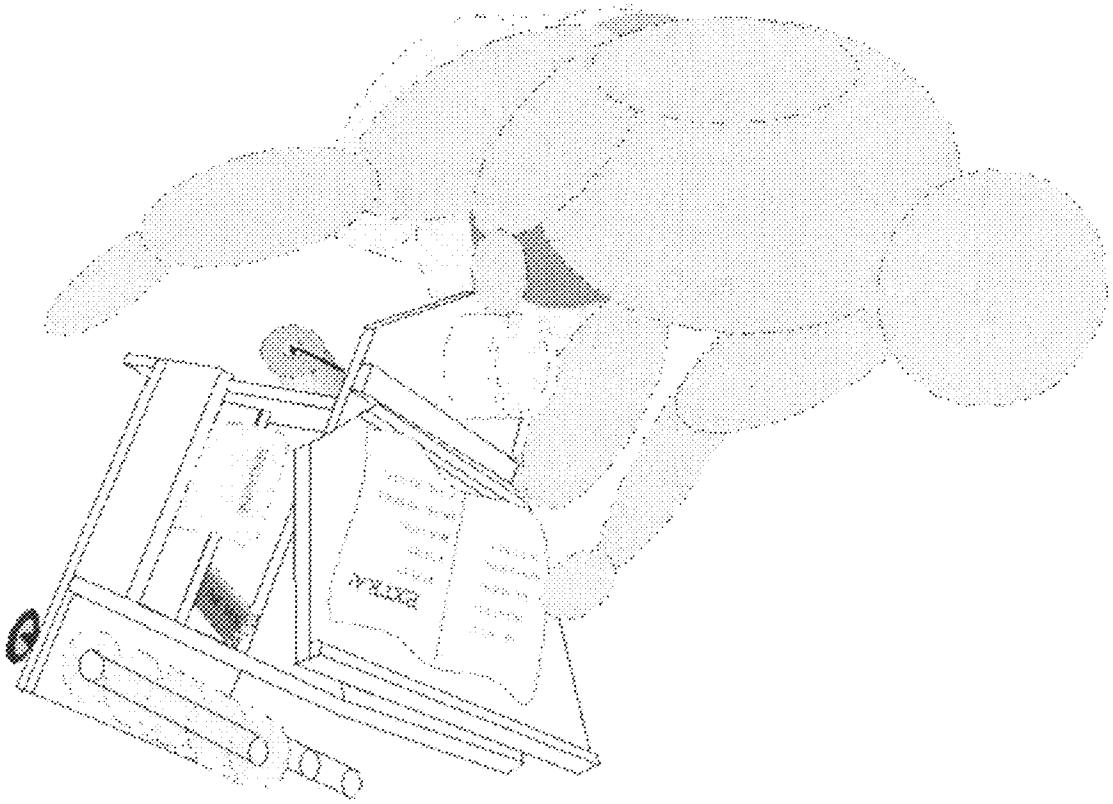
FIG. 8 is an upper perspective view of the present invention. User with the desk.

Sit on the commode, reach for the toilet users rollable desk handle (FIG. 2 ref 4) and lift slightly to raise the front and pull "caddy-style" towards the user then lower and place between the knees (FIG. 8) to be used in one of several ways in which:

Use office items to read, write and work on the desktop. (FIG. 8)

Place coffee or drinks on the shelf designed for said use. (FIG. 8)

Figure 7:
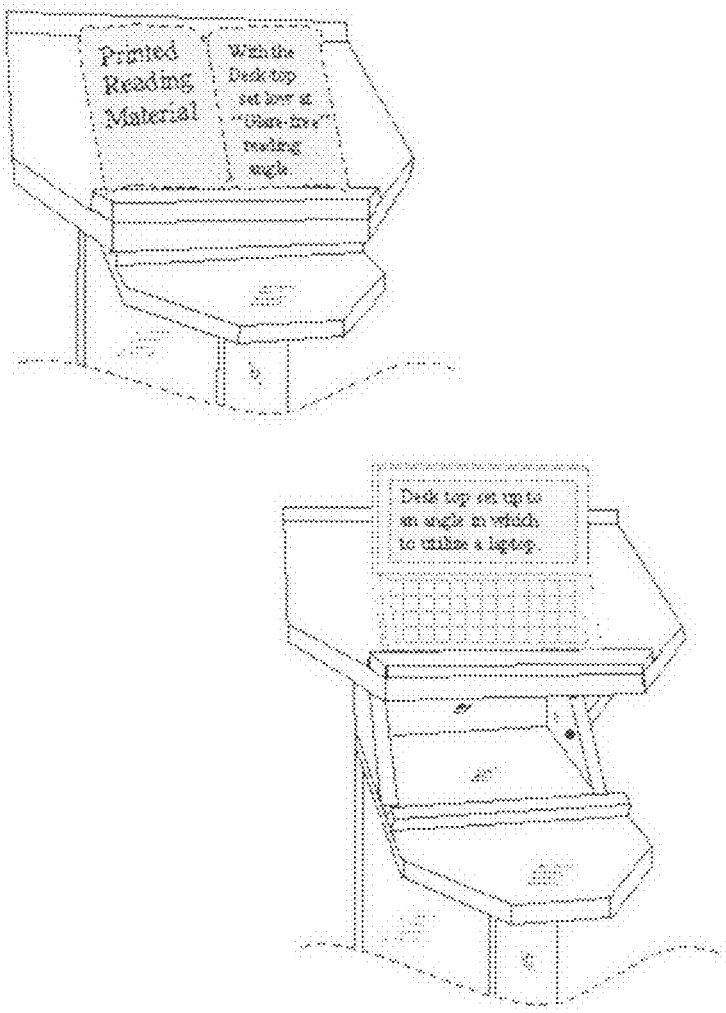
FIG. 7 is a second alternative embodiment of the present invention. User angles.

Take glossy printed material from the magazine rack and read at a low adjusted desktop angle that prevents glare to the eyes due to light reflectance at an uncomfortable viewing angle. (FIG. 7) upper drawing.

Open the desktop lid to remove a netbook computer and use at an upper required angle that allows for screen viewing, keyboard/mouse use. (FIG. 7) lower drawing.

Figure 3:
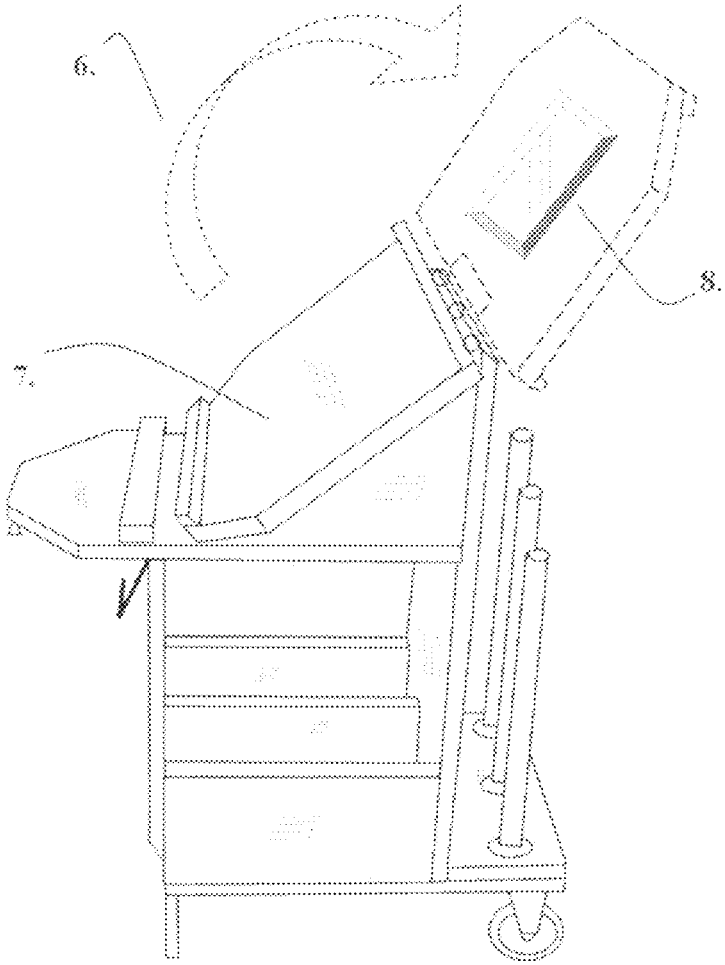
FIG. 3 is an exploded upper perspective view of the present invention. Open view.
Figure 4:
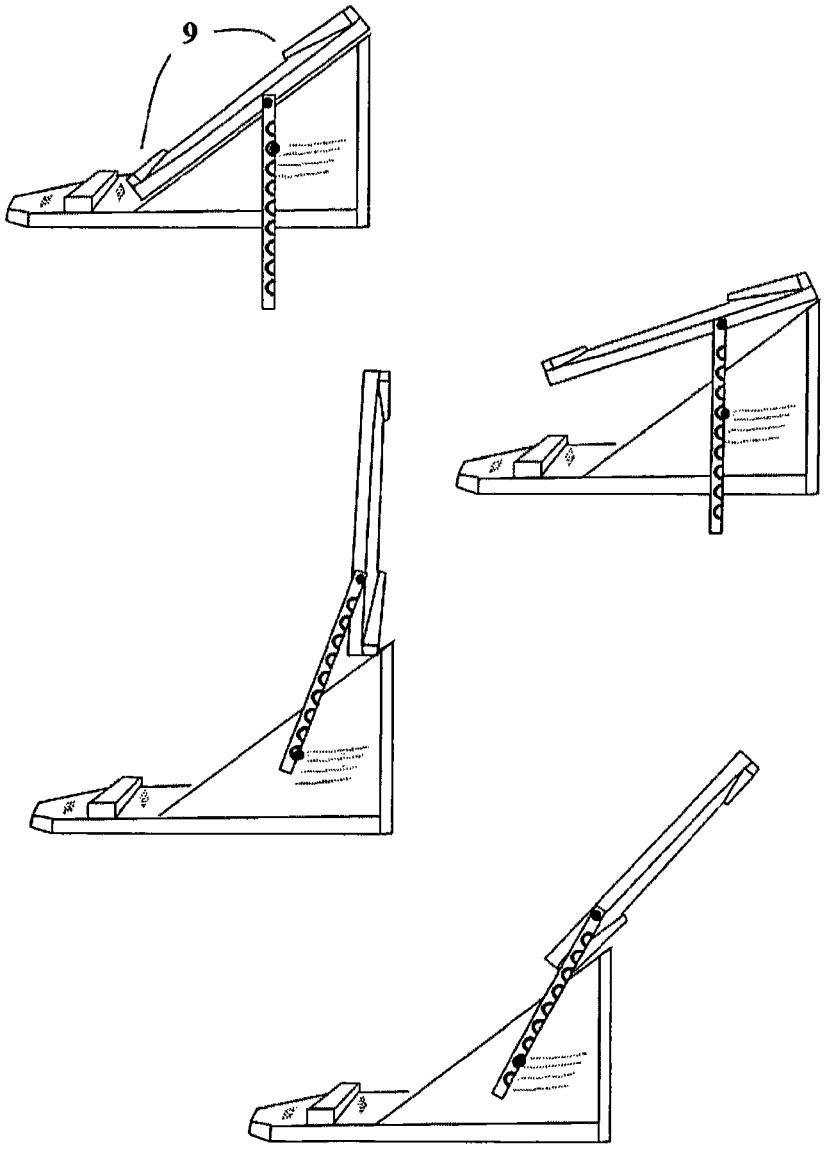
FIG. 4 is an alternative embodiment of the present invention. Upper perspective.

Rotate the desktop up and over to increase the reading area to facilitate open newspaper, blueprints, schematics or other "broad-page" items. (FIG. 3 ref 6)

Use the mirror under the desktop (FIG. 3 ref 8) to apply make-up, jewelry, shave with an electric razor or other personal viewing needs.

Store to consume medication, insert hearing aids, dentures or other personal items of similar nature.

Read and write messages on PDA's as well as send and receive cell-phone or other electronic messages.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Any headings utilized within the description are for convenience only and have no legal or limiting effect.

The invention claimed is:

1. A rollable desk for use in a bathroom comprising: (a) a desk top having a top surface, a bottom surface, a front end and a rear end; (b) an enclosed storage comprising at least one shelf to accommodate office and personal items; wherein said desk top is hinged at said rear end such that the desk top is capable of being pivoted upwards to reveal said enclosed storage; (c) a narrow pedestal having a front side and a rear side; said pedestal supports said desk top surface and is capable of being placed between a user's legs; (d) a single toilet tissue roll holder attached at the front side of the pedestal; (e) a horizontal surface supported by the pedestal; said horizontal surface having tapered sides at a front region such that the width of a rear region of the horizontal surface is greater than the width of the front region of the horizontal surface; (f) a base extending from the rear side of the pedestal; said base having a top surface, a bottom surface, a front end and a rear end; said base comprising a plurality of storage dividers extending upwards from the top surface of the base; (g) a plurality of poles extending upwards from the top surface of the base approximate to the rear end of the base to accommodate rolls of toilet tissue; (h) a pair of wheels attached to the bottom surface of the base approximate the rear end of the base; and (i) a non-skid kick plate attached to the bottom surface of the base approximate the front end of the base configured to allow the desk to stand firmly fixed in place when in use.

* * * * *